US005599235A

United States Patent [19]

Lynberg

[11] Patent Number: 5,599,235

[45] Date of Patent: Feb. 4, 1997

[54] COLLAPSIBLE SKATE RAMP

[76] Inventor: Roger Lynberg, 157 26th St., Del Mar, Calif. 92014

[21] Appl. No.: 515,817

[22] Filed: Aug. 16, 1995

[51] Int. Cl.[6] ..... A63C 19/10

[52] U.S. Cl. ..... 472/89; 14/69.5

[58] Field of Search ..... 472/88, 89, 90; 14/69.5, 71.1; 254/88

[56] References Cited

U.S. PATENT DOCUMENTS

| | | | |
|---|---|---|---|
| 3,663,015 | 6/1972 | Bynder et al. | 472/89 |
| 4,833,750 | 5/1989 | Gherling | 14/27 |
| 5,033,146 | 7/1991 | Fogarty et al. | 14/69.5 |
| 5,341,533 | 8/1994 | Seitz | 14/69.5 |

FOREIGN PATENT DOCUMENTS

| | | | |
|---|---|---|---|
| 1528447 | 10/1978 | United Kingdom | 472/89 |

*Primary Examiner*—Kien T. Nguyen

*Attorney, Agent, or Firm*—Hedman, Gibson & Costigan, P.C.

[57] ABSTRACT

A collapsible ramp for providing aerial lift for inline skates, skateboards, bicycles and the like made of at least two lateral sections which are attached wherein the sections include a base for engaging the ground, bracing for support and a riding surface, The leading section has an incline from the ground level and the final section has an incline to a launch height. Intermediate sections can be used between the leading and final sections,

16 Claims, 3 Drawing Sheets

COLLAPSIBLE SKATE RAMP

FIELD OF THE INVENTION

The present invention relates to ramps for providing aerial lift for skateboards, inline skates, bicycles or the like and, more particularly, a ramp that can be collapsed for storage or transportation.

BACKGROUND OF THE INVENTION

Skateboard, inline skates and bicycle enthusiasts have recently taken these pursuits to a new level of aerial acrobatics. However, to perform such maneuvers generally requires an inclined ramp or "half tube".

Most often a ramp will consist of a one piece plywood sheet between 3' and 8' long with a wood frame, milk carton or like support at the launch end and, possibly, some support bracing in the middle. For safety reasons, the ramp should be made as stable as possible to ensure a firm, constant surface during contact and take-off.

In this respect, the plywood generally used has the disadvantage of deflection unless extensively braced. To provide the necessary bracing, however, makes break down or disassembly of the ramp, once assembled, difficult or unavailable. As such, the more stable ramps are burdensome if not impossible to transport and/or to store.

Likewise, half tubes are usually fixed, semi-permanent structures which cannot be moved, requiring even more substantial bracing to maintain stability wherein they must withstand both take-off and landing.

It is therefore an object of the present invention to provide a ramp which is both sturdy and easily collapsed for transportation and/or storage.

SUMMARY OF THE INVENTION

These and other objects are achieved by the present invention of a collapsible ramp comprising at least two lateral sections and means for attachment of adjacent sections. Each section includes base means for engagement of a surface, support means for bracing and a riding surface, wherein a leading section further comprises an incline from ground level and a final section further comprises an incline to launch height.

Additionally, sections may be provided intermediate the leading and final sections. These may or may not include further areas of incline.

BRIEF DESCRIPTION OF THE DRAWINGS

The following drawings, wherein like reference characters represent like parts, are intended solely to illustrate the present invention and do not limit the present invention whatsoever.

DESCRIPTION OF THE PREFERRED EMBODIMENT

Figure 1:
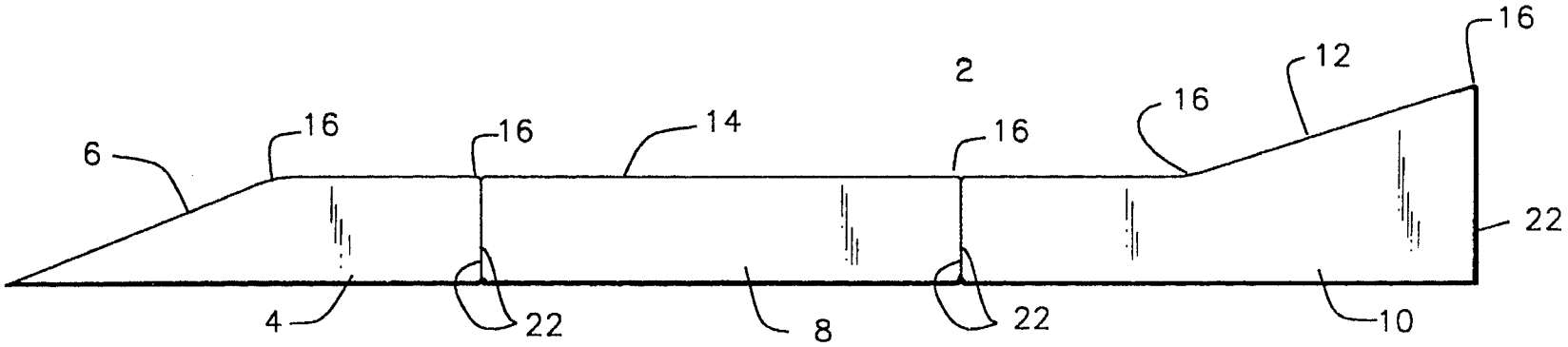
FIG. 1 is a side elevational view of the preferred embodiment of the present invention.

As shown in the drawings, and best seen in FIG. 1, the preferred embodiment of the collapsible ramp 2 of the present invention is made up of three sections. The leading section 4 includes an incline 6 from ground level to a predetermined height, the final section 10 includes an incline 12 from a predetermined height to a launch height and the intermediate section 8 maintains the predetermined height between the leading section 4 and final section 10.

All of the sections 4, 8 and 10 have a riding surface 14 which is textured to provide traction for the wheels of the user's skates, skateboard, bicycle, etc. Additionally, all of the sections 4, 8 and 10 include base members for contacting the ground surface (i.e. street, sidewalk, parking lot, etc.), support members for bracing the sections and attachment means for securing adjacent sections together. All of the top surface corners 16 of all of the sections are preferably rounded and smooth to limit injury should a user fall.

Figure 2C:
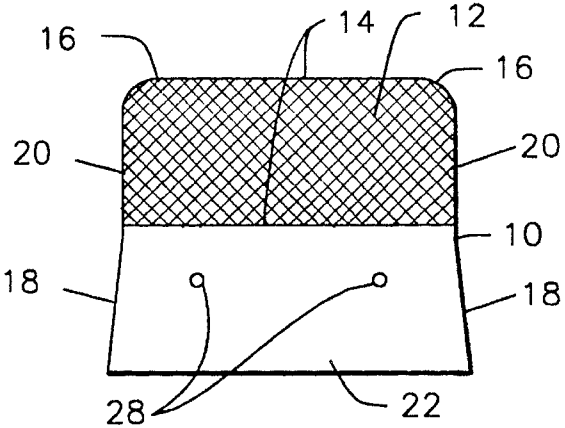
FIG. 2C is a front elevational view of the final section of the preferred embodiment.
Figure 2B:
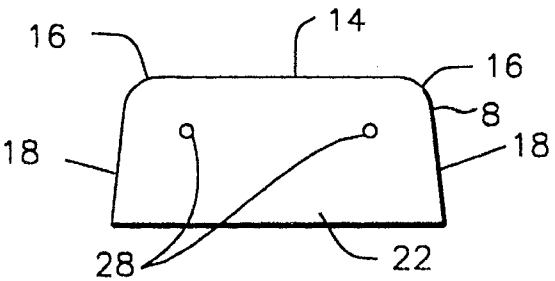
FIG. 2B is a front elevational view of the intermediate section of the preferred embodiment.
Figure 2A:
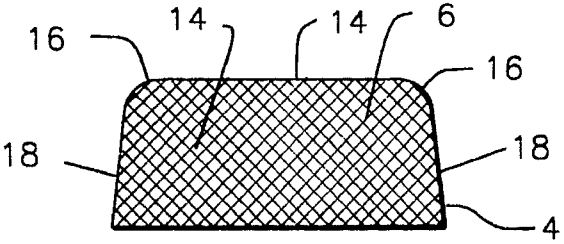
FIG. 2A is a front elevational view of the first section of the preferred embodiment of the present invention.
Figure 4:
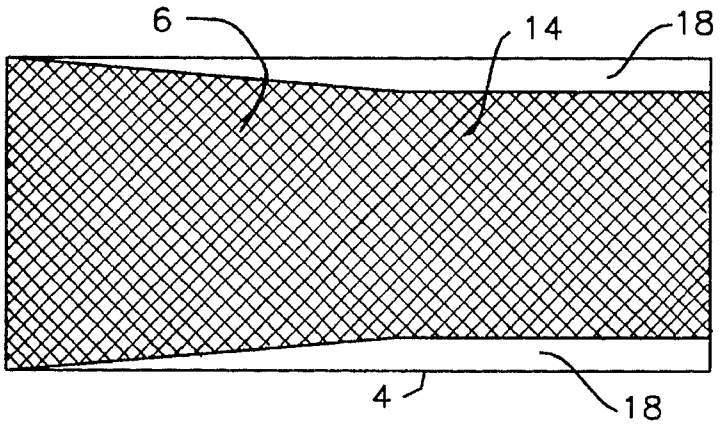
FIG. 4 is a top elevational view of the first section of the preferred embodiment.

As shown in FIGS. 2A–2C, the leading section 4, intermediate section 8 and final section 10 all have side walls 18 which are tapered inwardly at about a 1½° angle from the base to the predetermined height. This provides that the base of the sections 4, 8 and 10 are slightly larger (preferably about 16") than the top of the sections (preferably about 14") at the predetermined height of the riding surface 14. The incline 12 to launch height of the final section has vertical side walls 20 from the predetermined height to maintain constant the width of the riding surface 14 through the incline 12 to launch.

At the ends of the sections, excluding the end of the leading section 4 which begins the incline 6 from ground level, are bulkheads 22. The bulkheads 22 may be solid or partially open and are preferably integral to the side walls 18 and top of each section.

Figure 5:
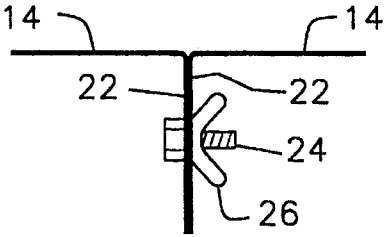
FIG. 5 is a partial side elevational view of attachment means for attaching adjacent sections of the preferred embodiment.

Attachment means for securing an adjacent section preferably comprise one or more bolts 24 and corresponding wing nuts 26 (see FIG. 5). The bolts 24 pass through holes 28 in adjacent bulkheads 22 and the wing nuts 26 are tightened secure the bulkheads 22 together.

Of course, other means for securing the adjacent sections together may be employed, including clamps, slotted grooves adapted to accept a tongued portion of an adjacent section, etc. However, the means selected should be universal so that the leading section 4 can be attached directly to the final section 10 or have any number of intermediate sections 8 therebetween.

Figure 3:
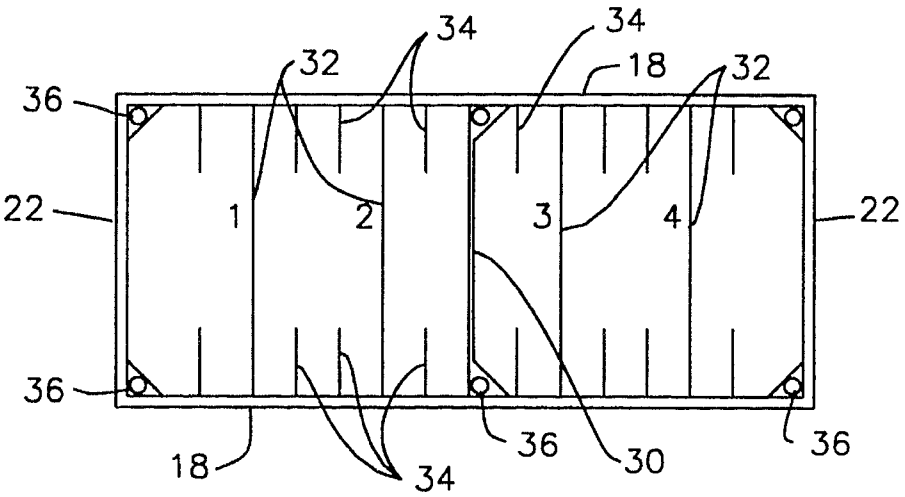
FIG. 3 is a bottom elevational view of any of the various sections of the preferred embodiment.
Figure 6B:
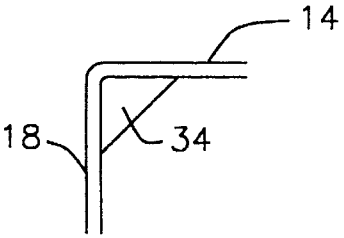
FIG. 6B is a partial elevational view of the gusset support for the various sections of the preferred embodiment.
Figure 6A:
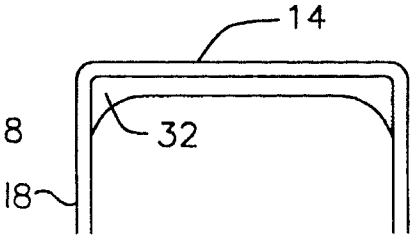
FIG. 6A is a partial front elevational view of the reinforcing rib support for the various sections of the preferred embodiment.
Figure 6:
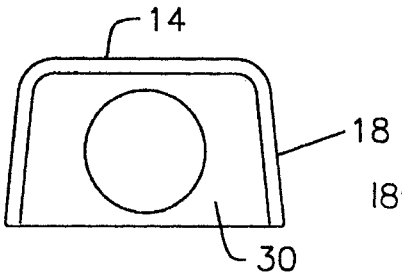
FIG. 6 is an elevational view of the cross member support for the various sections of the preferred embodiment.

Support means are included within each section to limit deflection of the riding surface 14 during use (see FIGS. 3 and 6–6B). Preferably, several levels of support are used, including a cross brace 30 in the middle of each section. Although the cross brace 30 shown in FIG. 6 is shown with an opening, it may be solid, etc., as long as the physical integrity can be maintained during use.

Additionally, the preferred embodiment further includes two (2) reinforcing ribs 32 between each bulkhead 22 and the cross brace 30, dividing the area between the bulkhead 22 and cross brace 30 into three portions. A version of the preferred reinforcing ribs 32 is shown in FIG. 6A.

In the most preferred embodiment, gussets 34 are included between the bulkheads 32 and reinforcing ribs 32, between successive reinforcing ribs 32 and between the reinforcing ribs 32 and cross brace 30, as shown in FIG. 3. One version of the preferred gusset 34 is shown in FIG. 6B.

To ensure proper footing of the ramp 2 on the ground surface, the ramp 2 includes base members for maintaining firm contact with the ground surface. Although the base members may be the bottom portions of the side walls 18, the bulkheads 22 and/or the cross braces 30 themselves, the preferred means are non-skid feet 36 on the ramp 2 to contact the ground surface.

Figure 7B:
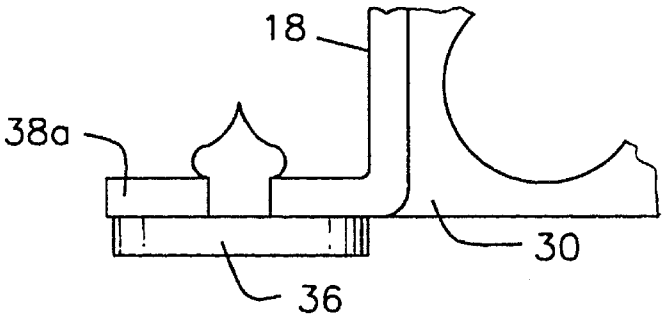
FIG. 7B is a cross sectional view of alternative base members of the preferred embodiment.
Figure 7:
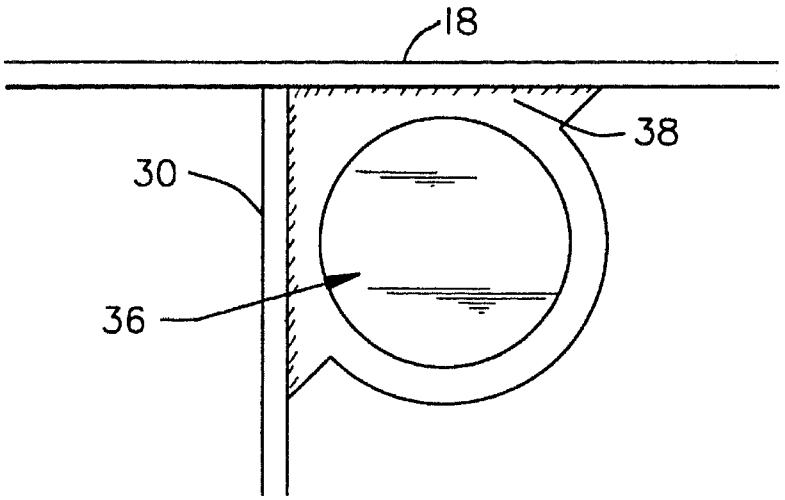
FIG. 7 is a partial bottom elevational view of anti-skid base members of the preferred embodiment.
Figure 7A:
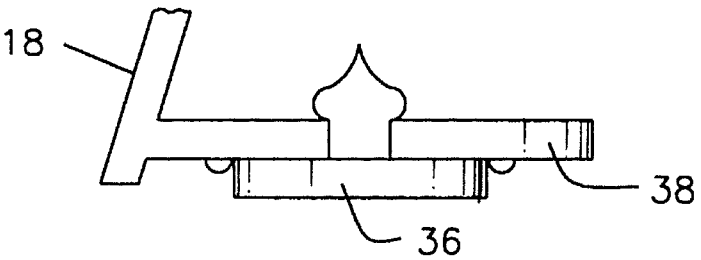
FIG. 7A is a cross sectional view of the preferred base members of the preferred embodiment.

In the most preferred embodiment, shown in FIGS. 3, 7 and 7A, the base means comprise rubber feet 36 which are mounted on retention members 38. The retention members 38 and feet 36 are preferably located internal to the side walls 18 and bulkheads 22 on each section at each of the corners between the side walls 18 and bulkheads 22 and at opposed corners between the side walls 18 and the cross braces 30 (see FIG. 3). Alternatively, as shown in FIG. 7B, the retention member 38*a* can be a ridge external to the side walls 18 of each of the sections.

The dimensions and specifications of the ramp 2 are not considered essential to the invention. Notwithstanding, the most preferred embodiment the sections 4, 8 and 10 are formed of a plastic, such as medium density polyethylene. The plastic is either blow molded or rotational molded to include all walls 18 and 20, surfaces 14, support members 22, 30, 32 and 34 and retention members 38 (or 38*a*). The riding surface 14 would preferably correspond to a textured surface on the mold, however, an applied texture can alternatively be used.

Each section 4, 8 and 10 of the most preferred embodiment is three (3) feet long, 16" wide at the base and 14" wide at the riding surface 14. The leading section 4 has a 20° incline 6 for 1½ feet from the ground surface to a horizontal height of 8". The incline 6 is followed by a rounded radius to a horizontal portion at 8" height for the remaining 1½ feet. The intermediate section 8 has a constant horizontal height of 8". The final section 10 has a horizontal height of 8" for the first 1½ feet, with a curved radius to a 16° incline 12 to launch. The incline 12 is 1½ feet to the end, rising an additional 5" over the 8" horizontal height to a total of 13" at launch.

The most preferred medium density polyethylene plastic of the preferred embodiment is approximately 0.2" thick at the riding surface 14 and the bulkheads 22. The side walls 18, cross brace 30, reinforcing ribs 32, gussets 34 and retention members 38 are preferably 0.125".

The radius of the corners from the side walls 18 to the riding surface 14 and from the launch end to the highest bulkhead 22 on the final section 10 are approximately ¼ to ½ inch. The radius of the rounded corners are approximately 1/16 to ⅛" from the riding surface 14 to the interior bulkheads 22. The radius from the incline 6 to horizontal riding surface 14 and then from the horizontal riding surface 14 to the incline 12 to launch is approximately ½ to 1 inch.

Variations from the above detailed description which make themselves apparent to those skilled in the art are within the spirit and scope of the present invention and are fully intended to be covered herein. The present invention is limited solely by the appended claims.

I claim:

1. A collapsible ramp for providing aerial lift to users of skates, skateboards, bicycles and the like comprising at least two lateral sections and attachment means for securing adjacent sections together, each section comprising a riding surface, side walls, support means, and base means for contacting a ground surface, wherein one of said at least two sections comprises a leading section further comprising an incline from the ground surface and another of said two or more sections comprises a final section comprising an incline to a launch height and further wherein the support means comprises one or more of bulkheads, cross braces, retaining ribs and gussets.

2. The ramp of claim 1 wherein said one or more sections further comprise one or more intermediate sections between the leading section and the final section.

3. The ramp of claim 2 wherein the riding surface of the intermediate section is horizontal.

4. The ramp of claim 1 wherein the riding surface comprises a textured surface.

5. The ramp of claim 4 wherein the textured surface is formed from the material of the riding surface.

6. The ramp of claim 4 wherein the textured surface is applied to the riding surface.

7. The ramp of claim 1 wherein the side walls are adapted to angle inwardly as they rise from ground level.

8. The ramp of claim 1 wherein the lateral sections are made from a plastic.

9. The ramp of claim 8 wherein the plastic is a medium density polyethylene.

10. The ramp of claim 1 wherein the base means further comprises non-skid feet for contacting the ground surface.

11. The ramp of claim 10 wherein the non-skid feet are made of rubber.

12. The ramp of claim 1 wherein the attachment means are adapted to a bulkhead at one or more ends of the section.

13. The ramp of claim 12 wherein the attachment means comprises universal means for attachment of the leading section to the final section or an intermediate section.

14. The ramp of claim 13 wherein the attachment means comprises a bolt and corresponding nut to secure adjacent bulkheads.

15. The ramp of claim 1 wherein the incline from the ground surface of the riding surface on the leading section is at an angle from the ground of from about 10° to about 30° to a horizontal portion.

16. The ramp of claim 15 wherein the incline to launch of the riding surface on the final section rises from the horizontal portion at an angle of from about 7° to about 25° to a launch height.

* * * * *